US006612506B1

(12) United States Patent
Huang

(10) Patent No.: US 6,612,506 B1
(45) Date of Patent: Sep. 2, 2003

(54) SPRAY GUN HEAD WITH DUAL AIR PORTS & A DIVERTER BUSHING

(76) Inventor: Tiao-Hsiang Huang, No. 190, Chung Cheng Rd., Shin Chuang City, Taipei Hsien (TW)

( * ) Notice: Subject to any disclaimer, the term of this patent is extended or adjusted under 35 U.S.C. 154(b) by 0 days.

(21) Appl. No.: 10/266,610

(22) Filed: Oct. 9, 2002

(51) Int. Cl.[7] ..... B05B 1/28; F23D 11/10; F23D 11/40; F23D 14/62

(52) U.S. Cl. ..... 239/291; 239/398; 239/290; 239/418; 239/526

(58) Field of Search ..... 239/398, 290, 239/291, 418, 526, 296, 297, 407, 416.5, 417.3, 417.5, 419.5, 420, 423, 424, 424.5, 425, 428.5, 433, 525, 548, 562, 600, DIG. 14

(56) References Cited

U.S. PATENT DOCUMENTS 1,990,823 A * 2/1935 Gustaffson ..... 239/8
2,029,423 A * 2/1936 Gustaffson ..... 239/296
2,511,626 A * 6/1950 Einbecker ..... 239/415
4,650,119 A * 3/1987 Pomponi, Jr. ..... 239/296
5,209,405 A * 5/1993 Robinson et al. ..... 239/296
5,279,461 A * 1/1994 Darroch ..... 239/297
5,344,078 A * 9/1994 Fritz et al. ..... 239/296
5,799,875 A * 9/1998 Weinstein et al. ..... 239/296
6,098,902 A * 8/2000 Culbertson et al. ..... 239/290
6,230,986 B1 * 5/2001 Vacher et al. ..... 239/297

* cited by examiner

*Primary Examiner*—Michael Mar
*Assistant Examiner*—Darren Gorman
(74) *Attorney, Agent, or Firm*—Rosenberg, Klein & Lee

(57) ABSTRACT

A spray gun head includes, a diverter bushing, a nozzle body, an air cap and a locking ring. First and second vent holes are separately provided in the spray gun head. The diverter bushing is provided with a plurality of jets disposed in relation to the first vent hole to form a first air port. The nozzle body is provided with an airflow guide ring having airflow guide holes disposed relative to the inner wall of the diverter bushing to form a second air port. A plurality of first jets and second jets are provided in the air cap which guards the nozzle body. Air from the first and the second vent holes flows-through the first air port, the second air port air, the diverter bushing and the airflow holes in the airflow guide ring to be respectively ejected from both air jets.

1 Claim, 3 Drawing Sheets

SPRAY GUN HEAD WITH DUAL AIR PORTS & A DIVERTER BUSHING

BACKGROUND OF THE INVENTION (a) Field of the Invention

The present invention is related to a structure of a spray gun head, and more particularly, to one that prolongs the service life and easier service of the spray gun head by modifying internal members that control airflow.

(b) Description of the Prior Art

As illustrated in FIG. 3 of the accompanying drawings, the prior art spray gun, includes a spray gun head (1), a nozzle body (3), an air cap (4) and a locking ring (5). Wherein, the spray gun head (1) contains a ring bearing (11), with the outer periphery of the ring bearing (11) being provided with a threaded section (111), and a vent hole (12). A nozzle carrying tube (13) is extended from the center at the base of the ring bearing (11). The vent hole is connected through to an inlet of low pressure air (16), and a threaded section (131) is provided inside the bore of the nozzle carrying tube (13) to be screwed to the nozzle body (3). A needle valve (17) is inserted to the other end of the nozzle carrying tube (13) with the needle valve (17) holding against the center of the nozzle body (3) and penetrating through a paint spreader hole (36). A pillar (31) is provided in the rear section of the nozzle (3) and a nozzle (32) is provided at the front end of the nozzle body (3). An air guide ring (33) is provided at the outer diameter of the pillar (31) and a plurality of airflow guide holes (34) are provided on the surface of the airflow guide ring (33). A threaded section (311) is provided at the terminal end of the pillar (31) of the nozzle body (3) corresponding to the threaded section (131) on the nozzle carrying tube (13). A hole (41) is provided at the center of the air cap (4) and a plurality of firstjets (42) and secondjets (43) are separately provided on the outer circumference of the air cap (4). A flange (44) protrudes from the inner side of the air cap (4). The locking ring (5) is a hollow ring cover and provided a threaded section (51) on the inner wall. The pillar (31) of the nozzle body (3) is screwed to the nozzle carrying tube (13) by engaging the threaded section (311) of the pillar (31) to the threaded section (131) of the nozzle carrying tube (13). The airflow guide ring (33) of the nozzle body (3) covers up the ring bearing (11) of the spray gun head (1) and the air cap (4) covers up the nozzle body (3). The nozzle (32) is exposed out of the hole (41) in the center of the air cap (4) and the locking ring (5) is screwed to the ring bearing (11) of the spray gun head (1) to lock and compress against the nozzle body (3) and the air cap (4) by holding against the flange (44) of the air cap (4). An air port space is formed between the nozzle body (3) and the spray gun head (1). By turning the locking ring (5) clockwise or counter-clockwise, the air port space as well as the air pressure between the firstjets (42) and the second jets (43) are regulated as desired. However, air pressure respectively from the first jets (42) and the second jets (43) is practically the same and that prevents easy regulation. Therefore, the nozzle could get easily blocked to shorten its service life and the blocked nozzle makes its clean maintenance extremely troublesome.

SUMMARY OF THE INVENTION

The first purpose of the present invention is to provide a spray gun head containing two units of air ports, and a diverter bushing that is capable of providing longer service life for the spray gun head and easier service of the spray gun head. To achieve the purpose, the present invention comprises a spray gun head, a diverter bushing, a nozzle body and an air cap; characterized in that a first vent hole and a second vent hole are separately provided in the spray gun head. The diverter bushing provides a plurality of jets in relation to the first vent hole of the spray gun head to form a first air port. The nozzle body provides an airflow guide ring having a plurality of airflow guide holes in relation to the inner wall of the diverter bushing to form a second air port. A plurality of first jets and second jets are provided in the air cap which guards the nozzle body. Air from the first and the second vent holes flows by following the first air port, the second air port, the diverter bushing and the airflow guide holes in the airflow guide ring to respectively eject out of the corresponding first and second jets in the air cap.

DETAILED DESCRIPTION OF THE PREFERRED EMBODIMENTS

Figure 1:
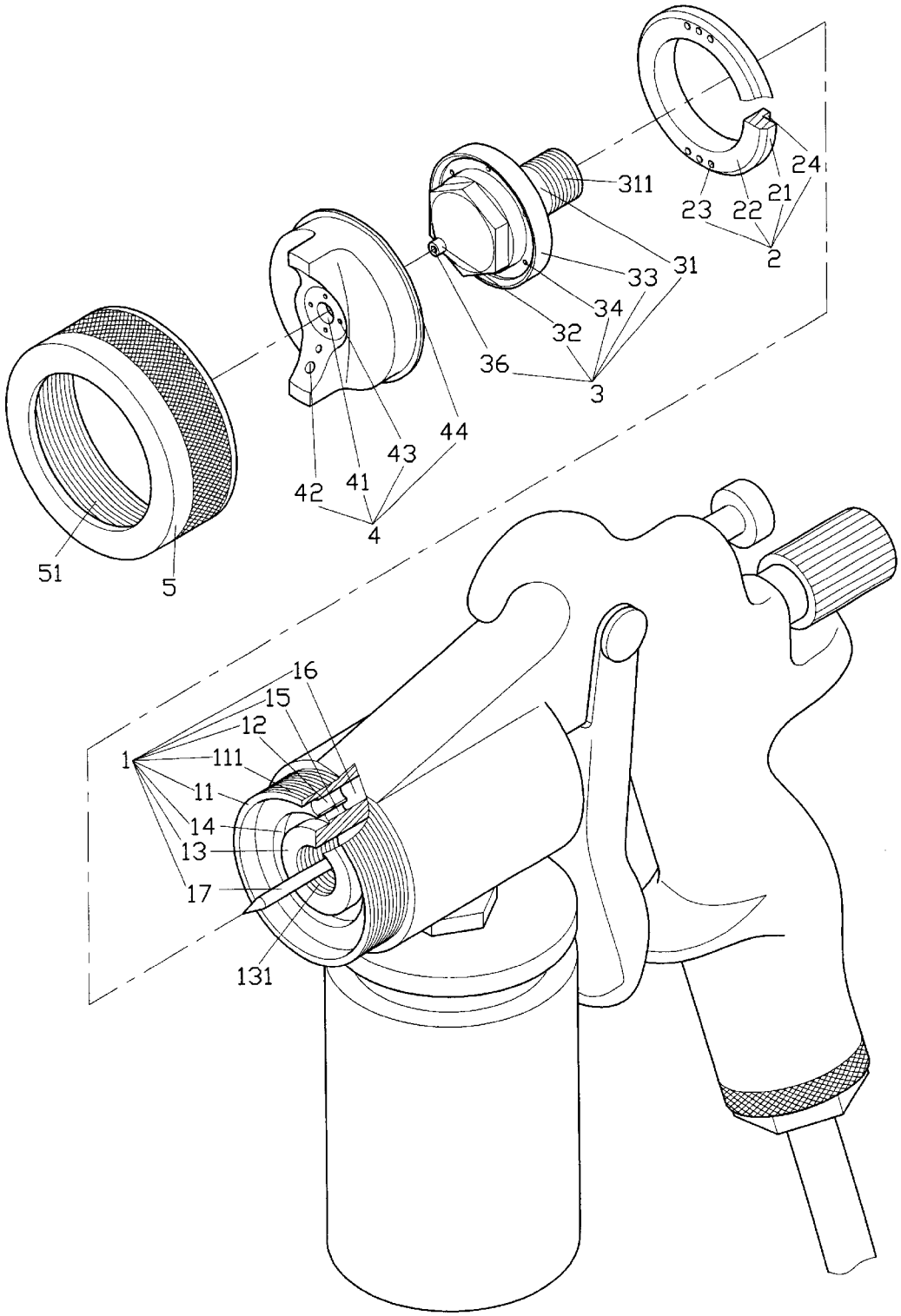
FIG. 1 is an exploded view of the present invention.
Figure 2:
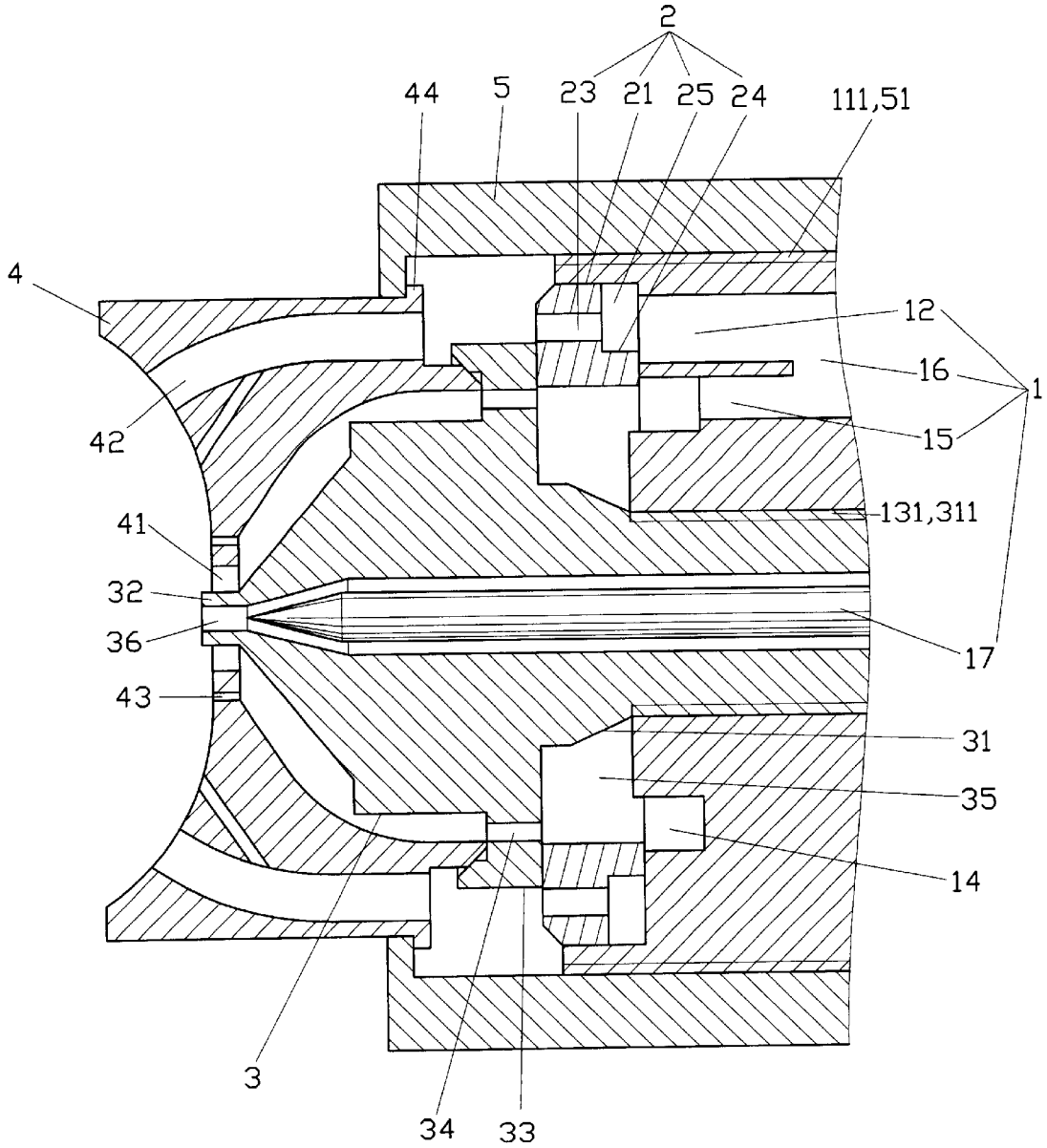
FIG. 2 is an enlarged cross-sectional view of the present invention as assembled.
Figure 3:
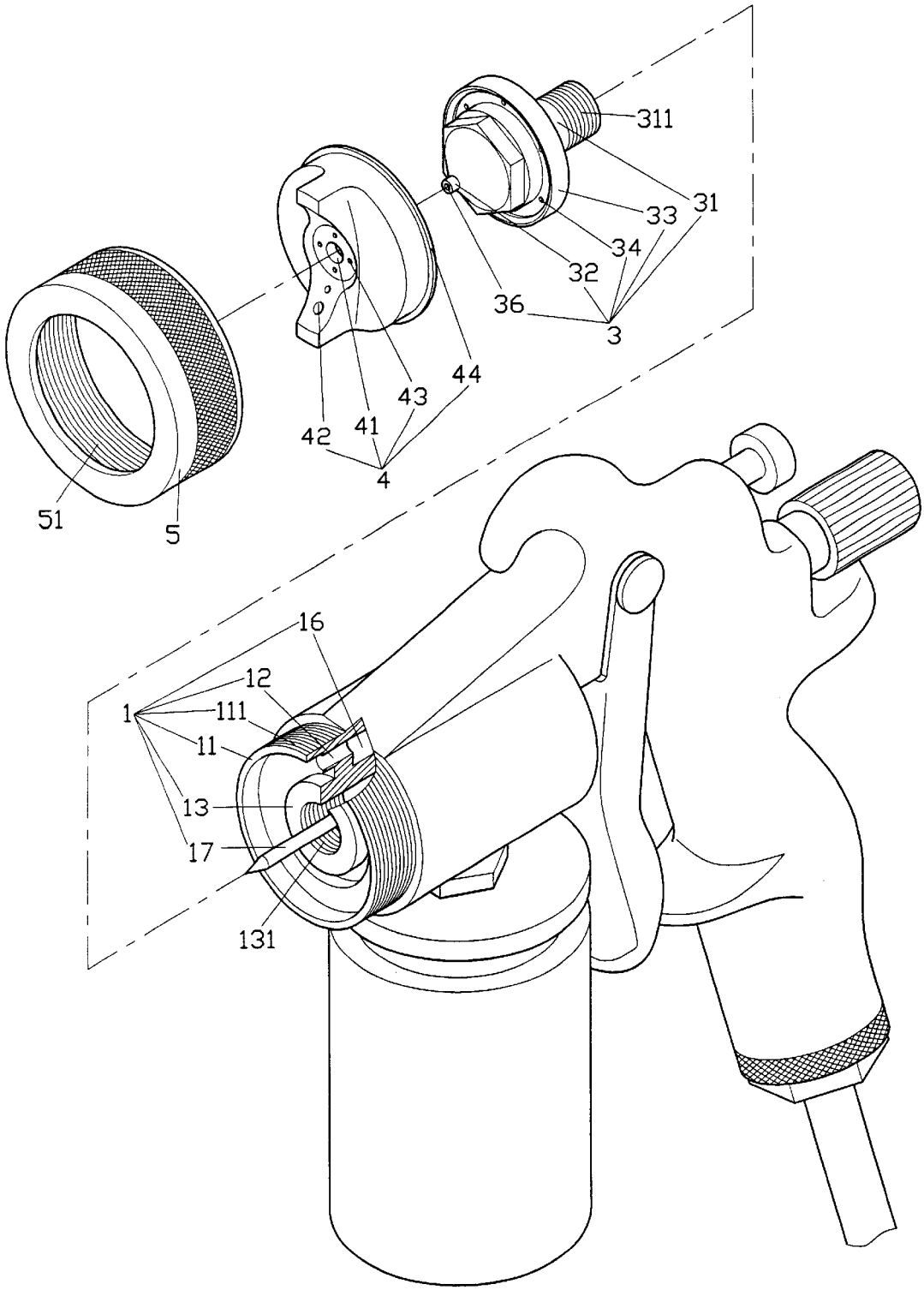
F I G . 3 (PRIOR ART)
FIG. 3 is an exploded view of a prior art spray gun.

Referring to FIGS. 1 and 2, a preferred embodiment of the present invention is comprised of a conventional spray gun body and an improved structure of a spray gun head (1) containing a diverter bushing (2), a nozzle body (3), an air cap (4) and a locking ring (5), wherein, the nozzle body (3), the air cap (4) and the locking ring (5) are members of the prior art.

The spray gun head (1) includes a ring bearing (11). A threaded section (111) is provided to the outer periphery of the ring bearing (11) and a first vent hole (12) connected through a low pressure air inlet (16) is provided on the inner at the base of the ring bearing (11). A nozzle carrying tube (13) extends from the center at the base of the ring bearing (11) and a circular groove (14) is provided around the outer circumference of the nozzle carrying tube (13). A second vent hole (15) is provided at the base of the circular groove (14). Both of the first vent hole (12) and the second vent hole (15) are commonly connected through the low pressure air inlet (16). A section of female thread (131) is provided in the bore of the nozzle carrying tube (13) for the nozzle body (3) to be screwed to the nozzle carrying tube (13). The other end of the nozzle carrying tube (13) is provided for insertion of a needle valve (17). The remaining parts of the structure of the spray head (1) are of the prior art and will not be repeated with their detailed description herein.

The diverter bushing (2) is a circular one provided with a first outer diameter (21) and a second outer diameter (24) with a vertical circular surface (22) of the first outer diameter (21) provided with a plurality of jets (23). The first outer diameter (21) is merely inserted into the bore of the circular bearing (11) of the spray gun head (1).

The nozzle body (3) comprises a paint spreader hole (36) through the center of the nozzle body (3), a pillar (31) at the rear portion, and a nozzle (32) at the front end. An airflow guide ring (33) is provided on the outer diameter of the pillar (31) and a plurality of airflow guide holes (34) are provided on the circular surface of the airflow guide ring (33). A threaded section (311) is provided on the terminal of the pillar (31) for the nozzle body (3) to engage the threaded section (131) of the nozzle carrying tube (13).

A circular hole (41) is provided at the center of the air cap (4) and a plurality of first jets (42) and second jets (43) are separately provided on the outer circular surface of the air cap (4). A flange (44) protrudes from the inner side of the air cap (4).

The locking ring (5) is a hollow ring cover provided with a threaded section (51) on the inner wall.

As illustrated in FIG. 2, the second outer diameter (24) of the diverter bushing (2) engages the circular groove (14) of the spray gun head (1) and a first air port (25) is formed between the diverter bushing (2) and the ring bearing (11). The pillar (31) of the nozzle body (3) penetrates through the diverter bushing (2) with the threaded section (311) of the pillar (31) engaging the threaded section (131) of the nozzle carrying tube (13). The airflow guide ring (33) of the nozzle body (3) is inserted to into the bore of the diverter bushing (2), and a second air port (35) is formed between the bore of the diverter bushing (2) and the pillar (31). The nozzle body (3) is guarded by the air cap (4) and the nozzle (32) is exposed from the circular hole (41) at the center of the air cap (4). The locking ring (5) is screwed to the ring bearing (11) of the spray gun head (1), and secures the diverter bushing (2), the nozzle body (3) and the air cap (4) by holding against the flange (44) of the air cap (4). Simply by turning the locking ring (5) clockwise or counter-clockwise, the space respectively in the first air port (25) and the second air port (35) is adjusted thus to change the pressure of the air ejected from the first jet (42) and the second jet. (43). If cleaning of the spray gun head (1) is required, the locking ring (5), the diverter bushing (2), the nozzle body (3) and the air cap (4) are removed to prolong the service life and easy service of the spray gun head (1).

I claim:

1. A spray gun head comprising a diverter bushing, a nozzle body, an air cap and a locking ring;

the spray gun head including (a) a ring bearing, (b); a threaded section provided on an outer periphery of the ring bearing, (c); a first vent hole provided in an inner base of the ring bearing, the first vent hole being connected through a low pressure air inlet, and (d); a nozzle carrying tube protruding from the center of the ring bearing, the nozzle carrying tube having a threaded section provided on an inner wall thereof, the nozzle body being screwed to the nozzle carrying tube, the nozzle carrying tube having a circular groove formed around an outer circumference thereof, a second vent hole being provided at the base of the circular groove, both of the first and second vent holes being connected through the low pressure air inlet;

the nozzle body including (a) a spreader hole penetrating a center of the nozzle body, (b); a pillar provided at a rear of the nozzle body, the pillar having a threaded section formed on a terminal end thereof and being screwed to the threaded section of the nozzle carrying tube, (c); a nozzle provided at a front end of the nozzle body, (d); an airflow guide ring provided at an outer diameter of the pillar and having a circular surface, and (e); a plurality of airflow guide holes provided on the circular surface of the airflow guide ring;

the air cap including (a) a circular hole provided at a center of the air cap,(b); a plurality of first jets and second jets separately provided on an outer circular surface of the air cap, the first and second jets being connected through the low pressure air inlet; and (c) a flange protruded from an inner side of the air cap;

the locking ring being a hollow ring cover provided with a threaded section on the inner wall; and, the diverter bushing having a circular shape and; including a first outer diameter and a second outer diameter, the first outer diameter having; a vertical circular surface provided with a plurality of jets, and the first outer diameter being inserted into the ring bearing of the spray gun head, the second outer diameter of the diverter bushing being engaged to the circular groove of the nozzle carrying tube, a first air port being formed between the diverter bushing and the ring bearing, the pillar of the nozzle body penetrating through the diverter bushing with the threaded section of the pillar engaging the threaded section of the nozzle carrying tube, the airflow guide ring of the nozzle body being inserted through the diverter bushing, a second air port being formed between the diverter bushing and the pillar, the nozzle body being guarded by the air cap and the nozzle being exposed from the circular hole at the center of the air cap, the locking ring secures the diverter bushing, the nozzle body and the air cap by pressing against the flange of the air cap and being screwed to the ring bearing of the spray gun head, and the space respectively in the first air port and the second air port being adjusted by turning the locking ring clockwise or counter-clockwise to change the pressure of the air ejected from the first jets and the second jets.

* * * * *